United States Patent [19]

Rethmeier

[11] 4,283,149

[45] Aug. 11, 1981

[54] PAPER TRANSPORTING DEVICE FOR CASH REGISTERS, DATA PROCESSING MACHINES OR THE LIKE

[75] Inventor: Gerhard Rethmeier, Bielefeld, Fed. Rep. of Germany

[73] Assignee: Control Commerce AG, Ilanz, Brabunden, Switzerland

[21] Appl. No.: 113,764

[22] Filed: Jan. 21, 1980

[30] Foreign Application Priority Data

Jan. 24, 1979 [DE] Fed. Rep. of Germany ..... 2902654

[51] Int. Cl.[3] ..... B41J 19/78; B41J 11/14

[52] U.S. Cl. ..... 400/617; 235/60.51; 400/569; 400/621

[58] Field of Search ..... 400/550, 568–570, 400/611, 617, 621, 636; 101/226–228; 226/181, 188; 235/58 CF, 60.51

[56] References Cited

U.S. PATENT DOCUMENTS

| | | | |
|---|---|---|---|
| 2,153,182 | 4/1939 | Gray | 235/60.51 |
| 3,075,626 | 1/1963 | Schultz | 235/60.51 X |
| 3,093,066 | 6/1963 | Adler | 400/617 X |
| 3,602,355 | 8/1971 | Hesse et al. | 400/570 |
| 3,756,149 | 9/1973 | Bishop | 101/228 |
| 4,043,440 | 8/1977 | Busch | 400/617 X |
| 4,167,345 | 9/1979 | Englund et al. | 400/570 X |

*Primary Examiner*—Paul T. Sewell

*Attorney, Agent, or Firm*—Herbert L. Lerner; Laurence A. Greenberg

[57] ABSTRACT

Paper transporting device for cash registers, data processing machines or the like, including a motor driven cam disc having a contoured surface and a plurality of depressions or varying depth formed therein, a gear segment lever pivotally mounted about a fixed axis, gear teeth and a roller integral with the gear segment lever, the roller being operable to contact the cam disc, a gear operable to mesh with the gear teeth of the gear segment lever, a free running clutch driveable by the gear, a paper transport roller driveable by the free running clutch, a device for locking the gear segment lever in a swungout position, and a pivotable curved lever having a free end, the curved lever being disposed in one of the depressions formed in the cam disc and being rotatable therewith, the free end of the curved lever being biased against the contoured surface of the cam disc.

6 Claims, 7 Drawing Figures

12
11
10a
10
6
10b
2
9
1
7
3
13
17
16
14
15
4

A
B
C
D
3
4
4a
5
17
18
19
20
21
22
23
24
25
PRINTING TIME 31
35
28
30
28
29
28a
17
4a 12
44
42
43
47
46
45
48
11
10
6
38
40
2
39
9
41
7
3
1
32
52
33
28
38
37
36
27
34
17
51
50
49
4a

PAPER TRANSPORTING DEVICE FOR CASH REGISTERS, DATA PROCESSING MACHINES OR THE LIKE

The invention relates to a paper transport device for cash registers, data processing machines or the like, having a motor driven cam disc with a gear segment lever which is pivotably supported about a fixed axis, and which is in contact with the cam disc through a roller. Gear teeth on the gear segment lever mesh with a gear which drives a paper transport roller through a free running clutch, and a locking mechanism is provided with arrests the gear segment lever in its swung-out position.

In paper transport devices of this type there is always only one depression provided on the cam disc. During rotation of the cam disc, the roller which is fastened to the gear segment lever can follow the depression, but this does not cause any motion of the paper transport roller because of the free running clutch which is provided in the drive mechanism. However, if the lever is raised at the end of a depression on the cam disc, a paper transport takes place, because the clutch locks in this direction. In paper transport devices for cash registers and similar apparatus, it is required for the device to perform paper advances of different lengths. For example, between two terms of a sum that are to be printed, an advance of only one line is required, while at the end of the addition a larger advance of two lines, for example, is desired, to separate the sum from the terms of the addition. For ejecting a receipt from a cash register, an advance of up to ten lines is required after printing the sum. To make such varied advances possible, it has been the regular practice up to now, in a paper transport device of this type, to provide several cam discs which have different depressions, disposed adjacent each other. This "cam package" was displaced sideways as required, so that the roller of the gear segment lever was running on the cam disc with the required depression. In paper transport of this type there was also a locking mechanism provided by which the gear segment lever could be arrested in its swung-out position, when no paper advance was desired, inspite of the rotation of the cam disc.

An important disadvantage of such known paper transport devices is the fact that a cam disc package has a relatively large mass, and therefore the setting in motion of the cam package and its sideways translation requires relatively great amounts of energy and takes a long time. Thus, a paper transport of this type is slow. This has proved to be disadvantageous, particularly since the introduction of the electronic calculator, because a paper transport device of this type is not capable of taking advantage of the speed made possible by the electronic calculator.

It is accordingly an object of the invention to provide a paper transporting device for cash registers, data processing machines or the like which overcomes the hereinafore mentioned disadvantages of the heretofore known devices of this general type, and makes it possible to perform paper advances of different lengths with a minimum energy requirement, and at a speed that matches the time of an electronic calculator.

With the foregoing and other objects in view there is provided in accordance with the invention, a paper transporting device for cash registers, data processing machines or the like, comprising a motor driven cam disc having a contoured surface and a plurality of depressions of varying depth formed therein, a gear segment lever pivotally mounted about a fixed axis, gear teeth and a roller integral with the gear segment lever, the roller being operable to contact the cam disc, a gear operable to mesh with the gear teeth of the gear segment lever, a free running clutch driveable by the gear, a paper transport roller driveable by the free running clutch, means for locking the gear segment lever in a swung-out position, and a pivotable curved lever having a free end, the curved lever being disposed in one of the depressions formed in the cam disc and being rotatable therewith, the free end of the curved lever being biased against the contoured surface of the cam disc.

By providing at least two depressions of different depth on the cam disc, it is possible to perform several paper advances of different length in a single revolution of the cam disc.

By the suitable operation of the locking device, the roller of the gear segment lever which runs on the cam, can be prevented from following a depression, so that no paper advance occurs inspite of the fact that a depression has passed. The curved lever makes it possible to provide at least one specially deep depression on the cam disc and also to have available several other depressions of varied depth during one revolution of the cam disc.

In accordance with another feature of the invention, there is provided a carrier disc disposed at a side of the cam disc, the cam disc and curved lever being fastened to the carrier disc.

It has been shown that the hereinafore described paper transport device is excellently suited to be combined with a cash register receipt cutting mechanism, with which in some cases a printing stamp may also be simultaneously combined to print the firm name and address at the upper end of the register receipt.

In accordance with a further feature of the invention, to combine the device with a cash register receipt mechanism, there is provided another pivotable gear segment lever disposed at a side of the carrier disc which is opposite the side thereof at which the cam disc is disposed, a knife disposed above paper tape which is partially wound on the paper transport roller, means for causing the knife to cut the paper upon pivoting of the other gear segment lever, a cam fastened to the carrier disc and having a rising curved surface, gear teeth and another roller integral with the other gear segment lever, the other roller being operable to run up the rising curved surface in a partly swung out pivot position of the other gear segment lever, another gear being operable to mesh with the teeth which are integral with the other gear segment lever and with the first mentioned gear that is operable to mesh with the gear teeth of the first mentioned gear segment lever, whereby the other gear segment lever swings out when the first mentioned gear segment lever swings in, and sliding pinion clutch means disposed intermediate the other gear and the first mentioned gear for causing a leading swing of the other gear segment lever.

In accordance with an additional feature of the invention, the other gear segment lever has a pin integral therewith, and the means for causing the knife to cut includes a rocker arm, the rocker arm having one end being movable by the pin and another end for operating the knife.

It is sometimes desired to print the same receipt twice. This is, for example, preferred in cash registers in restaurants, because the waiter frequently needs one receipt for the customer and one receipt for himself. In this case the two identical receipts are not completely separated in cutting. By disposing the cutting edge, as is conventional, at an angle with respect to the paper surface, the cash receipt can be completely or only partially cut, caused by more or less motion of the knife.

In accordance with an added feature of the invention, to make it possible to shift the mechanism described to partial cutting or complete cut-off, there is provided a slider movably disposed on the rocker arm, an electromagnet for moving the slider between two positions, a first stop spaced at a given distance from the pin and coming in contact with the pin in one of the positions of the slider, and a second stop spaced at less than the given distance from the pin and coming in contact with the pin at the other of the positions of the slider.

If the shorter stop lies before the pin in the second gear segment lever, the rocker arm is tilted less when the second gear segment lever is swung-out, so that the cash receipt is only partially cut. However, if the longer stop lies before this pin, the rocker arm is tilted a greater amount in the same motion of the second gear segment lever, so that the knife also travels a greater distance, and thus completely cuts off the cash receipt.

In accordance with a concomitant feature of the invention, if it is desired to print the name and address of a firm on top of the cash receipt the means for causing the knife to cut includes a carrier arm and a printing plate, the printing plate and the knife being secured to said carrier arm.

It is therefore possible to fasten the knife and a printing plate with a corresponding type together on a carrier, whereby the printing plate is disposed on the upstream side of the knife, so that when a receipt is cut off, simultaneously the corresponding imprint is effected for the next cash receipt.

Other features which are considered as characteristic for the invention are set forth in the appended claims.

Although the invention is illustrated and described herein as embodied in a paper transporting device for cash registers, data processing machines or the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
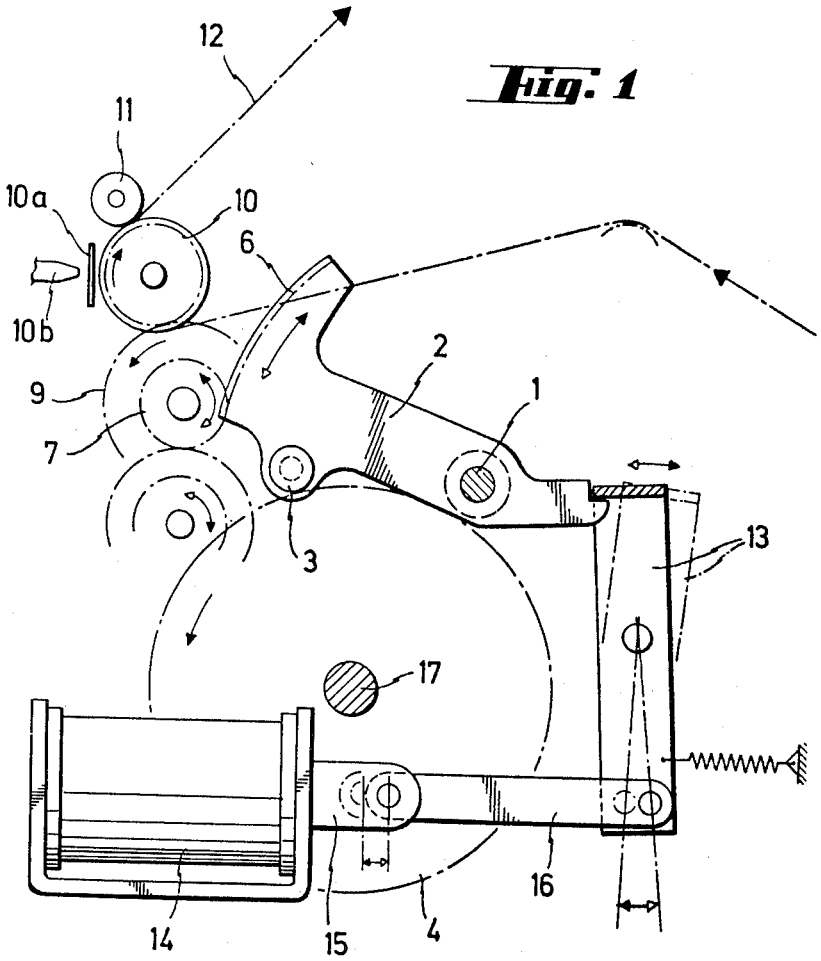
FIG. 1 is a diagrammatic side-elevational view of the paper transport device according to the invention.
Figure 5:
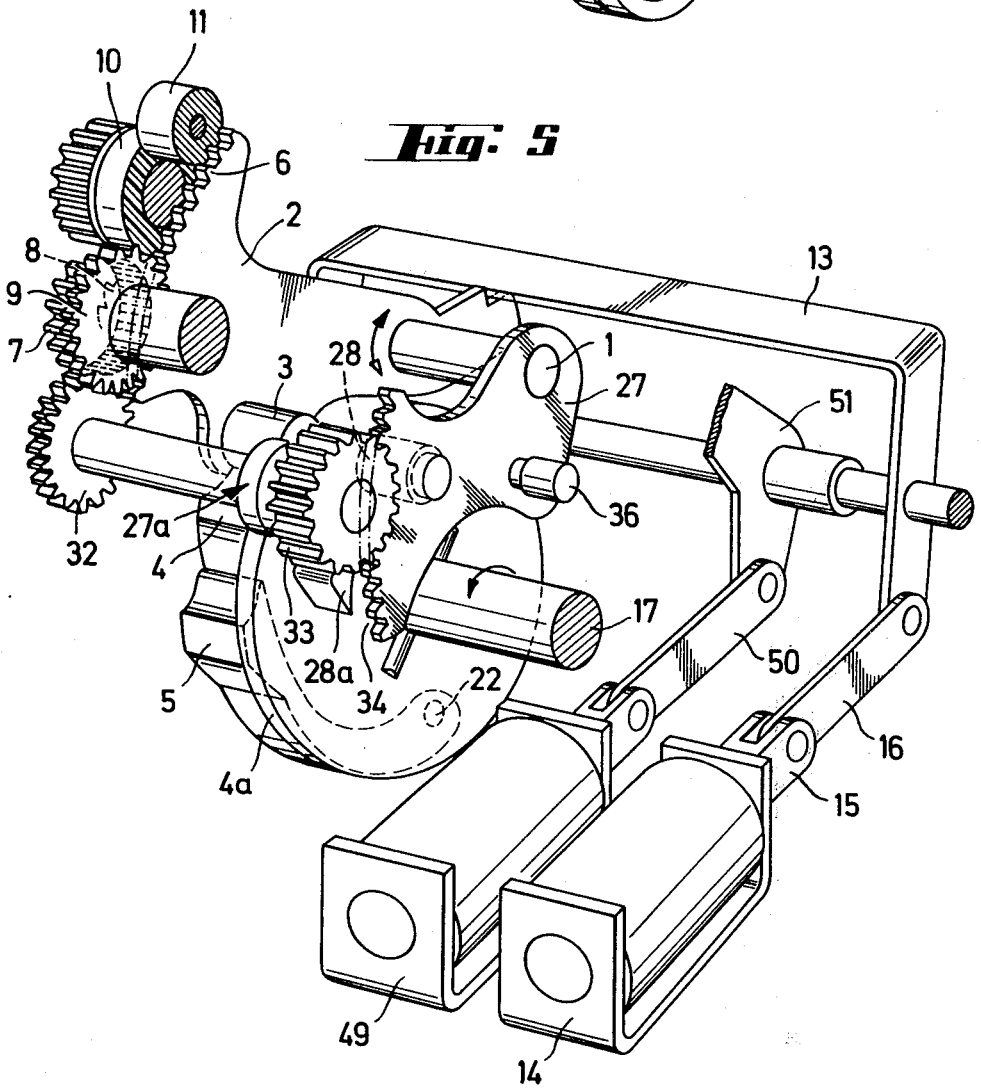
FIG. 5 is a diagrammatic perspective view of the device of FIG. 1, including important details of the receipt cutting mechanism of FIG. 3.
Figure 6:
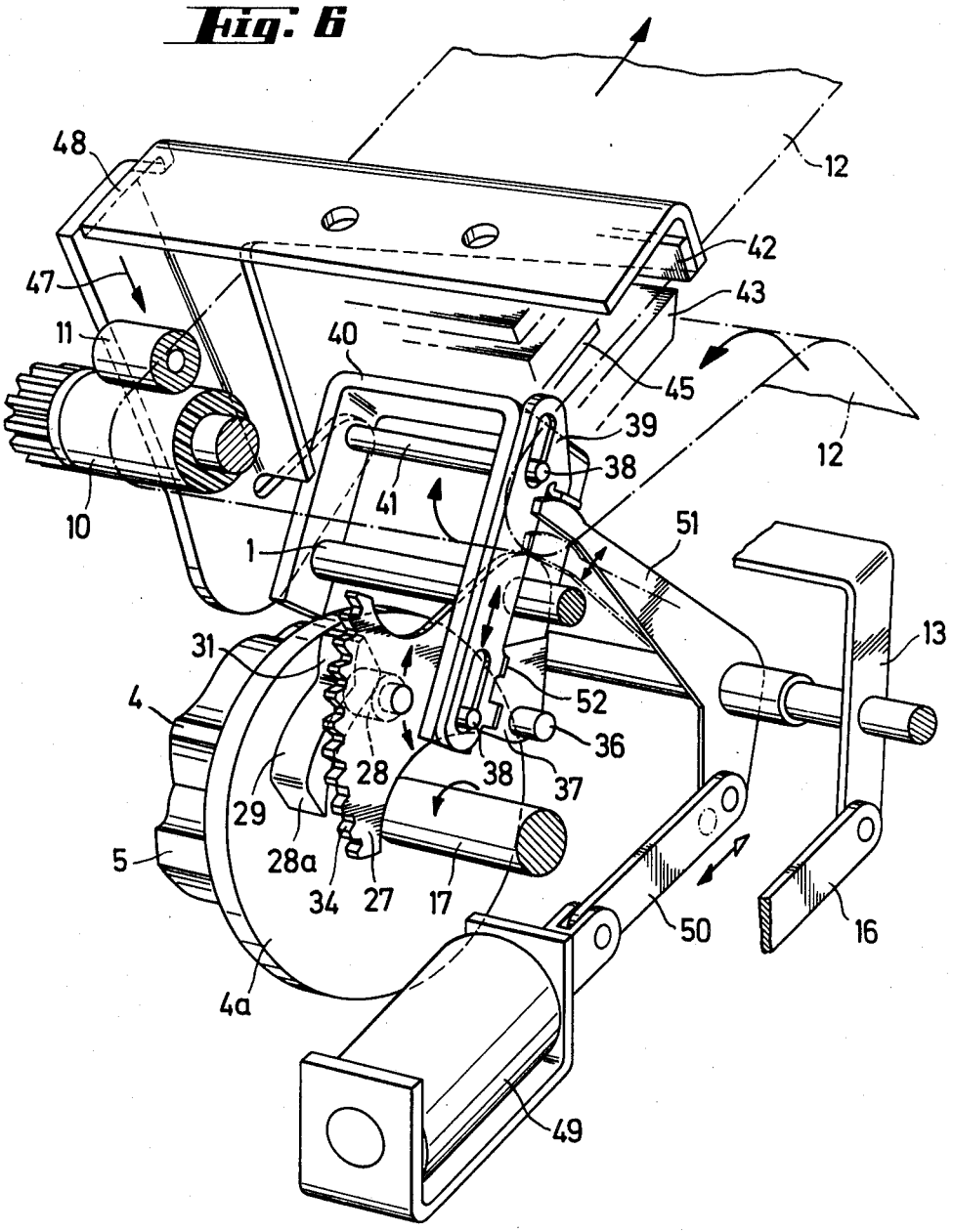
FIG. 6 is a diagrammatic perspective view showing important details of the cutting mechanism of FIG. 3.

Referring now to the figures of the drawing and first particularly to FIGS. 1 and 5 thereof, there is seen a first gear segment lever 2 which is supported on a fixed axis 1. A roller 3 is secured on the lever 2 which is pressed by a non-illustrated spring against a cam disc 4, that is in connection with a cam disc carrier 4*a*. A curved lever 5 is pivotally secured on the disc carrier 4*a* by means of a pivot pin 22, which is clearly shown in FIGS. 2 and 5. It can be seen from FIG. 2, that depending on its clearance or position, the roller 3 can follow different depressions, so that motions or run-offs A, B, C and D are made possible.

The teeth 6 of the gear segment lever 2 mesh with a gear 7. The gear 7 is in turn connected to a gear 9 through a free running clutch 8, and the gear 9 drives a paper transport roller 10. In front of the roller 10 there is a guided ink ribbon 10*a* and a printing stamp 10*b* for printing symbols. A counter roller 11 presses a paper tape 12 onto the paper transport roller 10.

When the gear segment lever 2 is pivoted counter clockwise, the gear 7 moves clockwise. With a rotation in this direction of the gear 7, the free running clutch 8 (shown in FIG. 5) does not drive the gear 9, and therefore the paper transport roller 10 does not move. Only when the gear segment lever 2 is lifted, does the gear 7 rotate counter clockwise, and therefore the free running clutch 8 is locked, the gear 9 is turned and the paper tape 12 is transported. If no transport is needed, the gear segment lever 2 is prevented from moving by the holding pawl 13. By providing current to an electromagnet 14, its armature 15 is pulled in, and the holding pawl 13 swings clockwise, so that the gear segment lever 2 is released and the paper can be transported, if the roller 3 can follow the lower contour of the cam disc 4 and the curved lever 5. As can be seen from FIG. 2, paper transports of different lengths can be effected in one revolution of the cam disc 4 due to the different depths of the depressions on the cam disc 4 and the curved lever 5, and by energizing the magnet 14 at the right moment in time.

ROLL-OFF MOTION A

Figure 2:
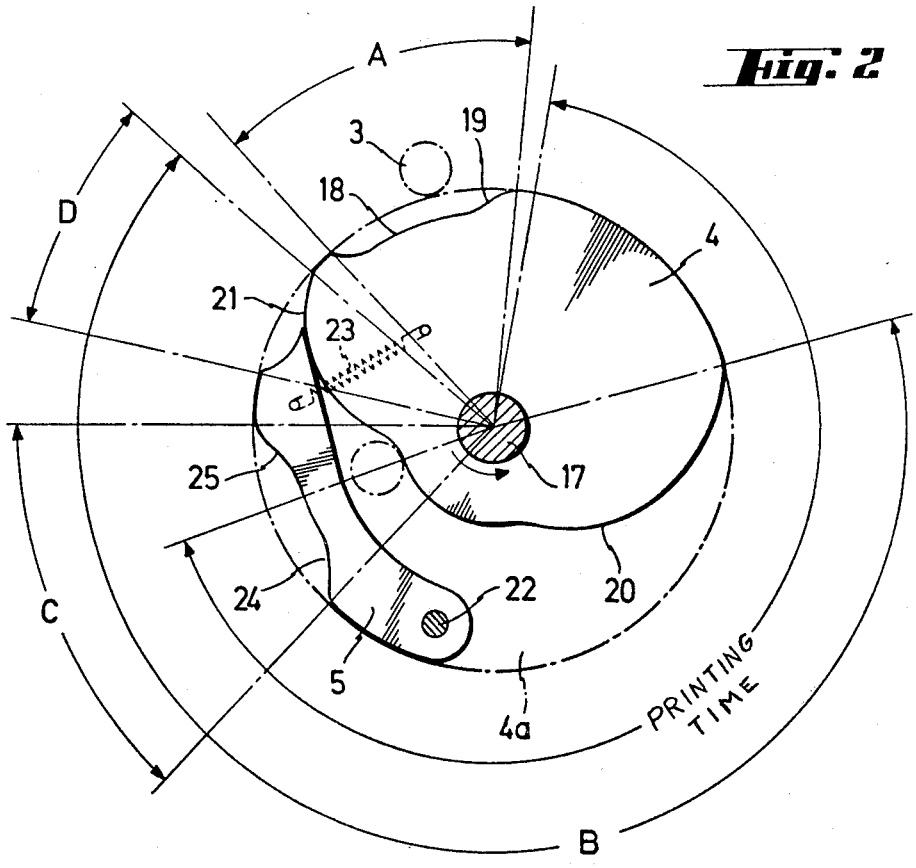
FIG. 2 is a detailed side-elevational view of the cam disk of FIG. 1.
Figure 4:
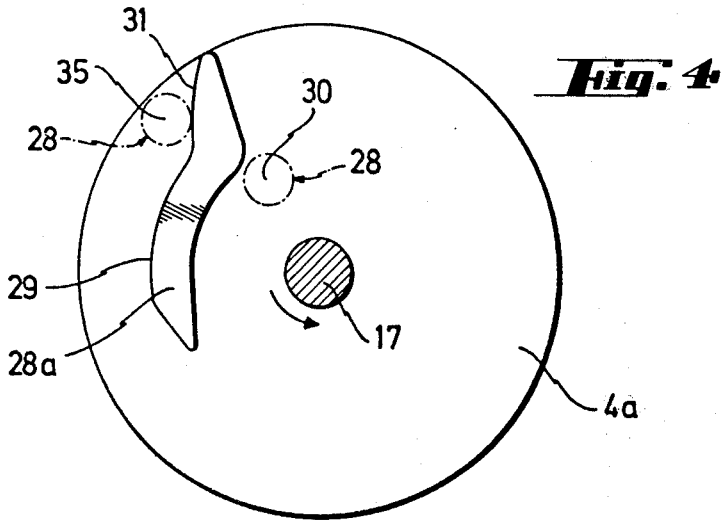
FIG. 4 is a detailed side-elevational view of the cam disc for the paper cutting mechanism.
Figure 3:
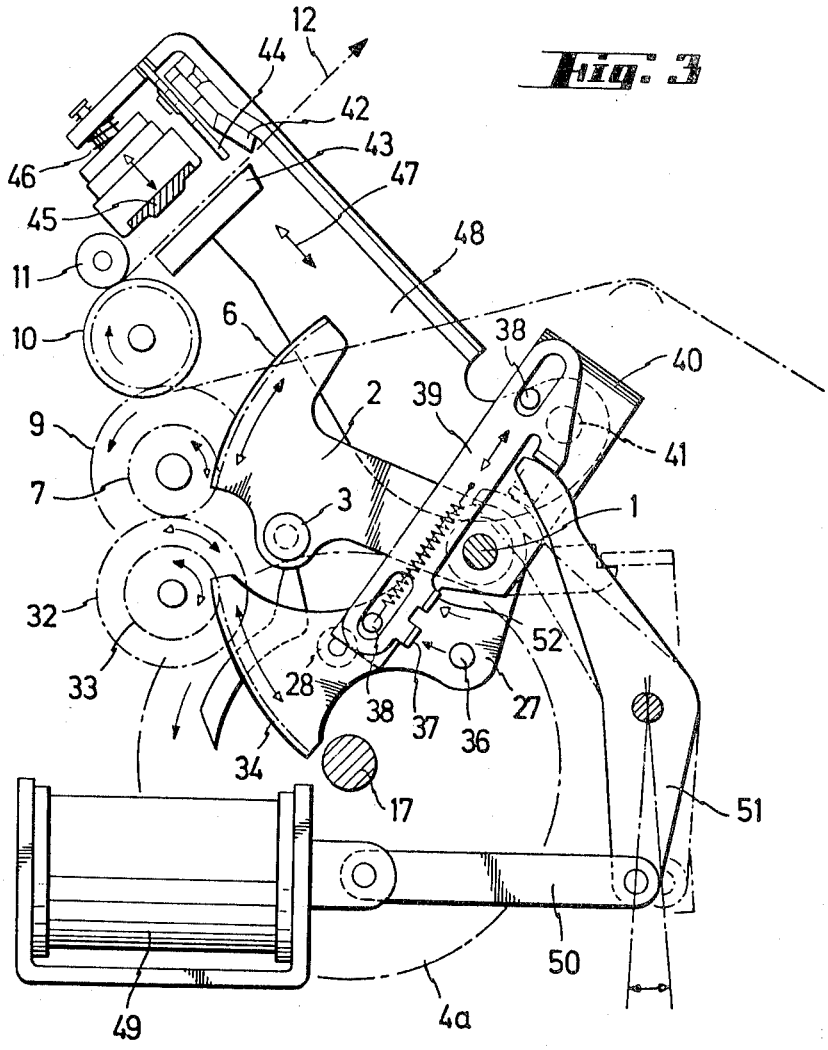
FIG. 3 is a view similar to that of FIG. 1, but with the receipt cutting mechanism and the stereotype or printing plate included.

In the starting position of the drive axis 17, the roller 3 of the gear segment lever 2 which is held by the pawl 13 in its starting position, is positioned above the portion A of the cam disc 4, as illustrated in FIG. 2. By providing current to the magnet 14 for a short time, the gear segment lever 2 is released, and moves counter clockwise pulled by spring force, until its roller 3 rests on the cam surface 18 of the cam disc 4. Because of the starting rotation of the cam disc 4 which has now begun, the roller 3 is pressed into its start position by the cam surface 19, and the paper is transported one line. Simultaneously the gear segment lever 2 is again locked by pawl 13.

ROLL-OFF MOTION B

The release of the gear segment lever 2 occurs at the beginning of motion B, so that the roller 3 can follow the cam surface 20. The paper transport is effected by pressing back the roller 3 by means of the cam surface 21. The path traveled by the gear segment lever 2 corresponds to a paper transport of 9 lines. The curved lever 5 which is pivotally supported on the pivot pin 22 is pressed to the outside by the roller 3 during its rise over the cam surface 21, and thereafter is again brought in contact with the cam disc 4 by a spring 23.

ROLL-OFF MOTION C

The release of the gear segment lever 2 at the beginning of motion C has the effect that the roller 3 follows the cam surface 24. The path of the gear segment lever 2 when pushing back the roller 3 with the cam surface 25, results in a paper transport of 2 lines.

ROLL-OFF MOTION D

When the gear segment lever 2 is released at the beginning of motion D, the roller 3 follows the cam surface 21. The path of the gear segment lever 2 by pushing back the roller 3 through the cam surface 21, results in a paper transport of one line.

In FIG. 2 the words "printing time" indicates a time interval during the rotation of the cam disc 4 and the curved lever 5, during which no paper transport takes place, regardless of which point in time the gear segment lever 2 is released. In this section there are only decreasing cam surfaces which, due to the action of the free-running clutch 8, do not cause the paper tape 12 to move. Therefore, there is a relatively long time during one revolution of the cam disc available for printing. In this way it is possible at the beginning of a single revolution, or at the end of a single revolution, to perform a paper transport of one line before printing, and to perform a paper advance of one line, of two lines or of nine lines after printing.

The following combinations are possible during one revolution of the cam disc:

A+B, A+C, A+D, A+C+D, C+D

Thereby it must be specially noted that for each combination there is a sufficient time provided during which the paper stands still for printing.

Combination A+B has special importance, if the sum is printed after an addition, and the register receipt is to be transported nine lines after printing. In this case when in a cash register the key "Sum" is pressed, an immediate release of the gear segment lever 2 is effected by the electromagnet 14, so that the roller 3 of the gear segment lever, shown in the starting position in FIG. 2, is lowered onto the cam surface 18 when starting the cam disc 4. When the roller 3 moves over the cam surface 19, a paper transport of one line occurs, with the result that the sum printed out thereafter is removed from the items in the addition by an additional line. The printing operation starts immediately thereafter, and the motion B starts and advances the paper by nine lines.

Figure 7:
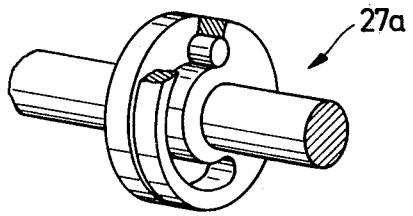
FIG. 7 is a detailed perspective view of the paper cutting mechanism of FIGS. 3 and 6.

The following is a description of the operation of the knife, with the aid of FIGS. 3 to 6. The basic position of a second gear segment lever 27 which is also pivotally supported on the fixed axis 1, is chosen in such a way that a roller 28 does not interfere with the rotation of a cam 28*a* which is fastened to the carrier disc 4*a*. As shown in FIG. 5, the gear teeth 34 of the gear segment lever 27 are in continuous engagement with a gear 33. The gear 33 is connected over a back-gear sliding pinion and stem gear or sliding pinion clutch 27*a*, which will be more fully explained hereinbelow, with a gear 32, that in turn meshes with the gear 7. This construction has the effect that when the first gear segment lever 2 is swung in, the second gear segment lever 27 swings out. Because of this construction, when the first gear segment lever 2 performs a large counter clockwise movement, i.e. when it makes the roll-off motion B, the second gear segment lever 27 is swung out so far that the roller 28 which is fastened thereto, is lifted over the height of the cam surface 29 of the cam 28*a*. The non-rising curve 29 on the cam 28*a* prevents the second gear segment lever 27 from falling back again. However, since the first gear segment lever 2 is again swung out with the continued rotation of the cam disc 4, but the second gear segment lever 27 cannot return, the sliding pinion clutch 27*a*, which is shown in detail in FIG. 7 is required. The sliding pinion clutch 27*a* includes two clutch discs, one of which is provided with a pin that is guided in a corresponding curved slot in the other clutch disc. With the further rotation of the cam carrier disc 4*a*, the roller 28 runs up a rising cam surface 31 of the cam 28*a*, so that the gear segment lever 27 is moved out still further, which is made possible by the sliding pinion clutch 27*a*. By these actions, the roller 28 is lifted from its basic position 30 to a raised position 35, shown in FIG. 4. In this position 35 of the roller 28, a pin 36 which is fastened to the roller lever 27 comes in contact with a stop 37 disposed on a slider or stop-carrier 39 that is made slideable by means of slots and pins 38. The pins 38 are secured on a rocker arm 40 which is rotatably supported on the axis 1, and engages the rod-support 41 of a longitudinally slideable carrier arm 48. A knife 42 is fastened to the carrier arm 48. In connection with an opposing knife 43, the knife 42 forms scissors for cutting-off the paper 12. Below the knife 42, there is a stripper 44 having spring action in the cutting direction. The stripper 44 prevents the clamping of the cutting edge of the paper remaining in the printing device under the knife 42. An automatically linked or self-moistening printing plate 45 is supported on the carrier arm 48 in such a manner that it is slideable in the direction of the printing pressure. A spring 46 opposes this sliding motion, and thus compensates for overshoot of the stroke of the carrier arm 48. The opposing knife 43 is so constructed that it also serves as a table for the pressure of the printing plate.

The following takes place in the cutting of the print-out:

The roller 3 of the gear segment lever 2 runs over the cam surface 20. This causes the gear segment lever 2 to swing in very far, which causes a correspondingly great outward movement of the gear segment lever 27. The roller 28 which is fastened to the gear segment lever 27 travels over the cam surface 29 of cam 28*a*, while the roller 3 of the gear segment lever 2 runs up the cam surface 21, and a paper advance of 9 lines is effected. The roller 28 of the gear segment lever 27 then runs up the quickly rising cam surface 31 and therefore the gear segment lever 27 is moved clockwise so far that the pin 36 is pressed against the stop 37 of the slider 39. This causes the rocker arm 40 to be activated and causes, through the rod support 41, the lowering of the carrier arm 48 with the knife 42 and the printing plate 45. The paper 12 between the knife 42 and the opposing knife 43 is therefore cut, whereby the type on the printing plate 45 is simultaneously printed.

The slider 39 can be brought to a different position by the magnet 49 by way of a pull-rod 50 and a lever 51, so that the pin 36 of the gear segment lever 27 comes in contact with a shortened stop 52. Therefore the travel of the carrier arm 48 is shortened, and the paper is only partly cut.

The paper transport device according to the invention makes it possible to effect paper advances of different length in a short time and fast sequence by the suitable control of the locking mechanism which acts on the first gear segment lever. For example, the combination of the roll-off motions A and B, which were explained hereinafore, can take place during one revolution of the cam disc which takes approximately 1.5 seconds. But during this time one line can also be printed. The speed with which the device, according to the invention, can operate is clearly shown by this example.

Though the paper transporting device according to the invention was specially explained with the aid of a cash register, it is quite clear that it can be used in all applications where paper advances of different length are to be obtained within short time intervals, as is required, for example, in data processing machines of all types.

There are claimed:

1. Paper transporting device, comprising a motor driven cam disc having a contoured surface and a plurality of depressions of varying depth formed therein, a gear segment lever pivotally mounted about a fixed axis, gear teeth and a roller integral with said gear segment lever, said roller being operable to contact said cam disc, a gear operable to mesh with said gear teeth of said gear segment lever, a free running clutch driveable by said gear, a paper transport roller driveable by said free running clutch, means for locking said gear segment lever in a swung-out position, and a pivotable curved lever having a free end, said curved lever being disposed in one of said depressions formed in said cam disc and being rotatable therewith, said free end of said curved lever being biased against said contoured surface of said cam disc.

2. Device according to claim 1, including a carrier disc disposed at a side of said cam disc, said cam disc and curved lever being fastened to said carrier disc.

3. Device according to claim 2, including another pivotable gear segment lever disposed at a side of said carrier disc which is opposite the side thereof at which said cam disc is disposed, a knife disposed above paper tape which is partially wound on said paper transport roller, means for causing said knife to cut the paper upon pivoting of said other gear segment lever, a cam fastened to said carrier disc and having a rising curved surface, gear teeth and another roller integral with said other gear segment lever, said other roller being operable to run up said rising curved surface in a partly swung out pivot position of said other gear segment lever, another gear being operable to mesh with said teeth which are integral with said other gear segment lever and with said first mentioned gear that is operable to mesh with said gear teeth of said first mentioned gear segment lever, whereby said other gear segment lever swings out when said first mentioned gear segment lever swings in, and sliding pinion clutch means disposed intermediate said other gear and said first mentioned gear for causing a leading swing of said other gear segment lever.

4. Device according to claim 3, wherein said other gear segment lever has a pin integral therewith, and said means for causing said knife to cut includes a rocker arm, said rocker arm having one end being movable by said pin and another end for operating said knife.

5. Device according to claim 4, including a slider movably disposed on said rocker arm, an electromagnet for moving said slider between two positions, a first stop spaced at a given distance from said pin and coming in contact with said pin in one of said positions of said slider, and a second stop spaced at less than said given distance from said pin and coming in contact with said pin in at the other of said positions of said slider.

6. Device according to claim 3, 4 or 5, wherein said means for causing said knife to cut includes a carrier arm and a printing plate, said printing plate and said knife being secured to said carrier arm.

* * * * *